US005658222A

United States Patent [19]

Brown

[11] Patent Number: 5,658,222

[45] Date of Patent: Aug. 19, 1997

[54] PORTABLE PERSONAL GYM AEROBIC EXERCISE EQUIPMENT

[76] Inventor: Dennis Brown, 1358 Hooper Ave., Ste. 240, Toms River, N.J. 08753

[21] Appl. No.: 608,562

[22] Filed: Feb. 28, 1996

[51] Int. Cl.[6] ..... A63B 22/04

[52] U.S. Cl. ..... 482/52; 482/51

[58] Field of Search ..... 482/51–53, 198, 482/908, 142, 130, 148

[56] References Cited

U.S. PATENT DOCUMENTS 4,856,775 8/1989 Colledge et al. ..... 482/142
5,145,476 9/1992 Chiarello ..... 482/53
5,407,407 4/1995 Lin ..... 482/53

*Primary Examiner*—Jerome Donnelly
*Assistant Examiner*—Denise Pothier
*Attorney, Agent, or Firm*—Charles I. Brodsky

[57] ABSTRACT

A carrying case is provided having first and second facing sections rotatably opened and closed, a normally collapsed exercise unit within the first section including a pair of pneumatic cylinders coupled to a pair of pressure actuated steps, a handle to extend the exercise unit for use whereby one is able to alternately lower and raise the steps by exerting a downward force on them, and further incorporating means for fastening the exercise unit, once extended, to the other facing section to secure it in position when being used.

14 Claims, 16 Drawing Sheets

PORTABLE PERSONAL GYM AEROBIC EXERCISE EQUIPMENT

FIELD OF THE INVENTION

This invention relates to the ability to exercise while away from one's home and/or health club and, more particularly, to a new improved exercise gym that is compact enough to fit into a portable case (or "carrying unit") that can be carried about from place-to-place as one would carry a suitcase.

BACKGROUND OF THE INVENTION

As is well known, physical fitness has become an important aspects of people's lives. Health clubs are being built daily to keep up with the demand for membership, and home exercise equipment is being purchased as fast as it can be manufactured. As is also known, home exercise equipment is generally purchased by persons who: a) believe membership prices are to high; b) do not like the crowds or standing on line to use a piece of equipment; c) do not have time to go to a health club; d) do not live near a health club; or e) enjoy exercising in the comfort of their own home.

Many homes, however, do not have the space to dedicate for use as a physical fitness area. So, the excercise equipment industry has addressed this problem by manufacturing smaller, lighter exercise equipment that is advertised as being foldable, or which can roll, tuck under beds, stand in closets, or set off by itself as being decorative. As a result of the improvements made in the size and weight of these exercise equipments, the home-gym market has increased rapidly, exposing, though, a problem that previously went largely unaddressed—that is, that humans are creatures of habit.

More particularly, and as will be appreciated, each piece of exercise equipment available has a distinct manner of operating —with pulleys, levers, rubberbands, plates, springs, etc. —, resulting in each piece of equipment having its own individual feel. When a person first uses a new piece of equipment, then, the movement often feels unnatural and awkward. As usage continues and muscles are trained how to move, the home-gym action then becomes more natural feeling than with health-club equipment. Such fact was not so noticeable before home-gyms were commonplace, as most exercising previously was done at a health club, which generally had the same equipment from club-to-club. When a person becomes accustomed to his, or her, home-gym apparatus, on the. other hand, they generally are not able to go to a health-club and find the same equipment to exercise on, with the very possible result of their then skipping the exercise program altogether when they are unable to exercise at home.

One further problem with all of this, moreover, is the tremendous variety of types of exercise equipment that is being advertised for this home-gym use. In fact, it is almost impossible to switch through the dials of a television and not find one piece of home-gym equipment or other advertised by this or that celebrity, or by this or that television personality. With some of that equipment being touted as being "aerobic" in nature, and with others being claimed promotive of "muscle building", a novice viewer is very hard pressed to decide whether to purchase this one, or that one, or several of them, or none at all. But, as a closer viewing will show, just about none of the advertised equipments are of the type that one can carry about—as when going on vacation, or as when just going on a business trip. As will be appreciated, the most likely time when a home-exercise person will go to a health club is when that person is away from home on these pleasure or business trips—as otherwise, they would then be able to use whatever equipment they may own, or choose to buy, at their home.

Although some of these equipments have been dubiously claimed to be small enough and light enough to be considered portable, on closer inspection, they will be seen to be thus movable, only about the home. More specifically, they will be seen not to be so designed, or packable, or transportable enough to be taken from the home on a regular basis. This then leaves the traveler without a piece of exercise equipment that he, or she, can feel comfortable using. At the same time, if an executive at an office, or a businessman at a temporary location different from his regular office wishes a few minutes exercise to reduce stress or to otherwise take a break in an otherwise busy day, a duplicate set of home-gym equipment would be required. For most intents and purposes, obviously, this does not present a viable alternative. Clearly, some kind of home-gym type equipment would be desirable, which can be easily transported and carried about from place to place.

OBJECTS OF THE INVENTION

It is an object of the present invention, therefore, to provide a new, inexpensive, durable, portable type of home-exercise gym which a user can carry about from place-to-place while traveling.

It is also an object of the invention to provide such a home-exercise gym which can provide both aerobic and muscle building exercises in a manner to enhance variety without having to go to a health club to perform different types of movement in performing different exercise activities.

It is an additional object of the invention to provide such equipment as can be broken-down to fit within a portable case, of a size comparable to a suitcase.

It is a further object of the invention to provide such gym equipment as lightweight as possible, so as to facilitate its being carried about.

It is yet another object of the invention to such equipment as may be used in a home or office environment, and which can be carried back and forth in a package that is attractive in appearance and can be managed by men and women alike.

SUMMARY OF THE INVENTION

As will become clear from the description that follows, the portable personal gym of the invention provides equipment for aerobic exercising, as well as additional equipment for muscle building. As will also be seen, each such equipment can be packaged in briefcase-sized units of the order of 1 foot×2 feet×8 inch or so, with its own carry handle, and which can then be coupled one to another to be carried about as a simple suitcase. As will also be described, the exercise equipment in each can be assembled and disassembled for use and storage, and can be adjusted to fit individual size and exercise needs. With the particular equipments designed, moreover, an overall total weight of approximately 30 to 35 pounds can result, to allow for easy transporting about.

In one version of the invention, one of the briefcase-sized units is provided with an easily assembled "stepmaster" type of aerobic exercise equipment which can be adjusted in tension. As will also be seen, the second briefcase-sized unit includes muscle building equipment, which can again be tailored to fit the desires of the user in exercising the legs, arms, shoulders, back and chest areas, as desired—and which can be adjusted as proficiency increases. Common to both, as will be seen, is the fact that the "carrying unit" in each instance serves more than just a means of transporting the equipment from place-to-place; it also serves as a part of the equipment itself in affording the features of the invention.

BRIEF DESCRIPTION OF THE DRAWINGS

These and other features of the present invention will be more clearly understood from the following description, taken in connection with the accompanying drawings, in which.

DETAILED DESCRIPTION OF THE DRAWINGS

In the following description, it is to be understood that the portable personal gym of the invention embodies the features of including aerobic exercise equipment in an easily carryable case, including muscle building equipment in a second such case, and joining the two cases together as a suitcase. As will also be seen, new and novel constructions are also set forth as constituting the aerobic exercise and muscle building equipments being carried about, and constitute several independent inventive features as well. Thus, although the following description sets forth preferred manners of building and utilizing the concepts of the portable gym intent of the invention, resort should be had to the claims appended here, to for a full understanding of the several different advances to the art which constitute each improvement associated with its particular use in the home or office, and in the travel-exercise applications of the portable personal gym.

AEROBIC EXERCISE EQUIPMENT

Figure 1:
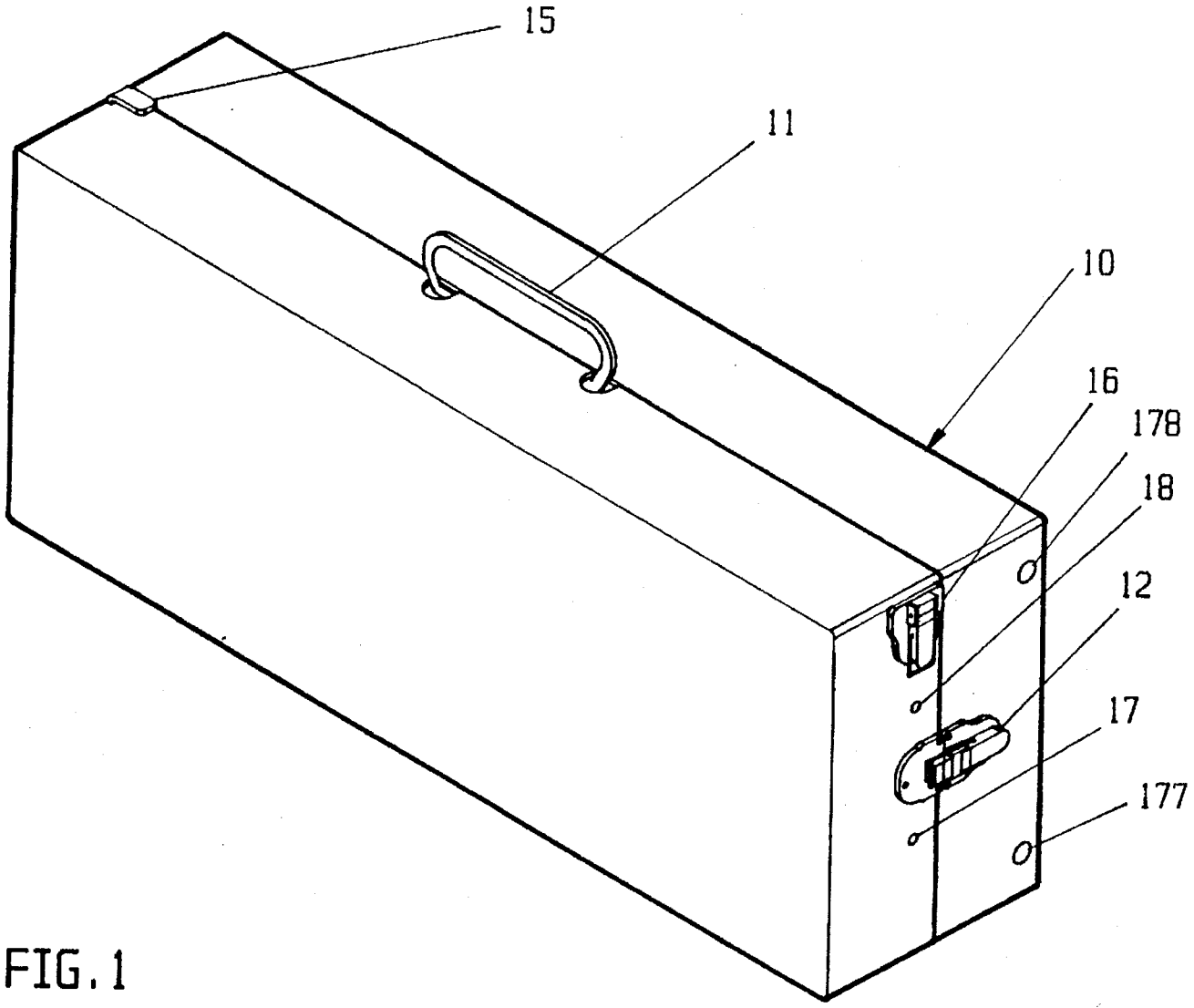
FIGS. 1–6 are various pictorial views helpful in an understanding of the "stepmaster" type of aerobic exercise equipment available for carrying as a briefcase, constructed in accordance with one aspect of the present invention.
Figure 2:
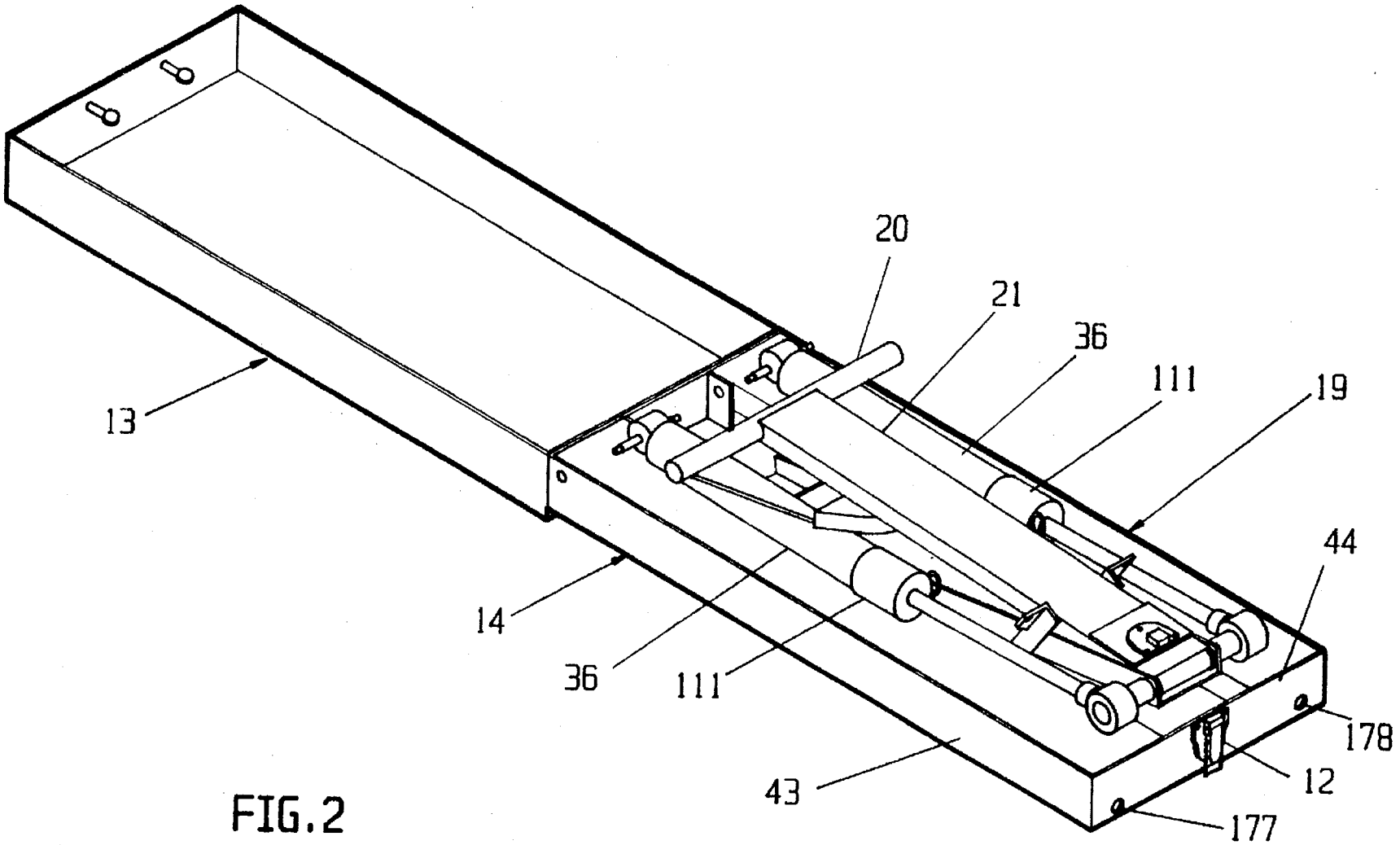

In particular, FIGS. 1–6 illustrate this aspect of the portable gym. As shown, when being transported, or stored for use, the aerobic exercise equipment is maintained in a briefcase-sized unit 10 of approximately 1 foot×2 feet×8 inch size or so, having a carry handle 11 and a latch 12 of any appropriate configuration to keep its two half sections 13 and 14 together. When the latch 12 is released, the two sections 13 and 14 can be rotated open about a hinge 15, and laid flat on a floor, as shown in FIG. 2. The latch 16 of FIG. 1 and the threaded apertures 17 and 18 of FIG. 1 will be subsequently described.

Figure 3:
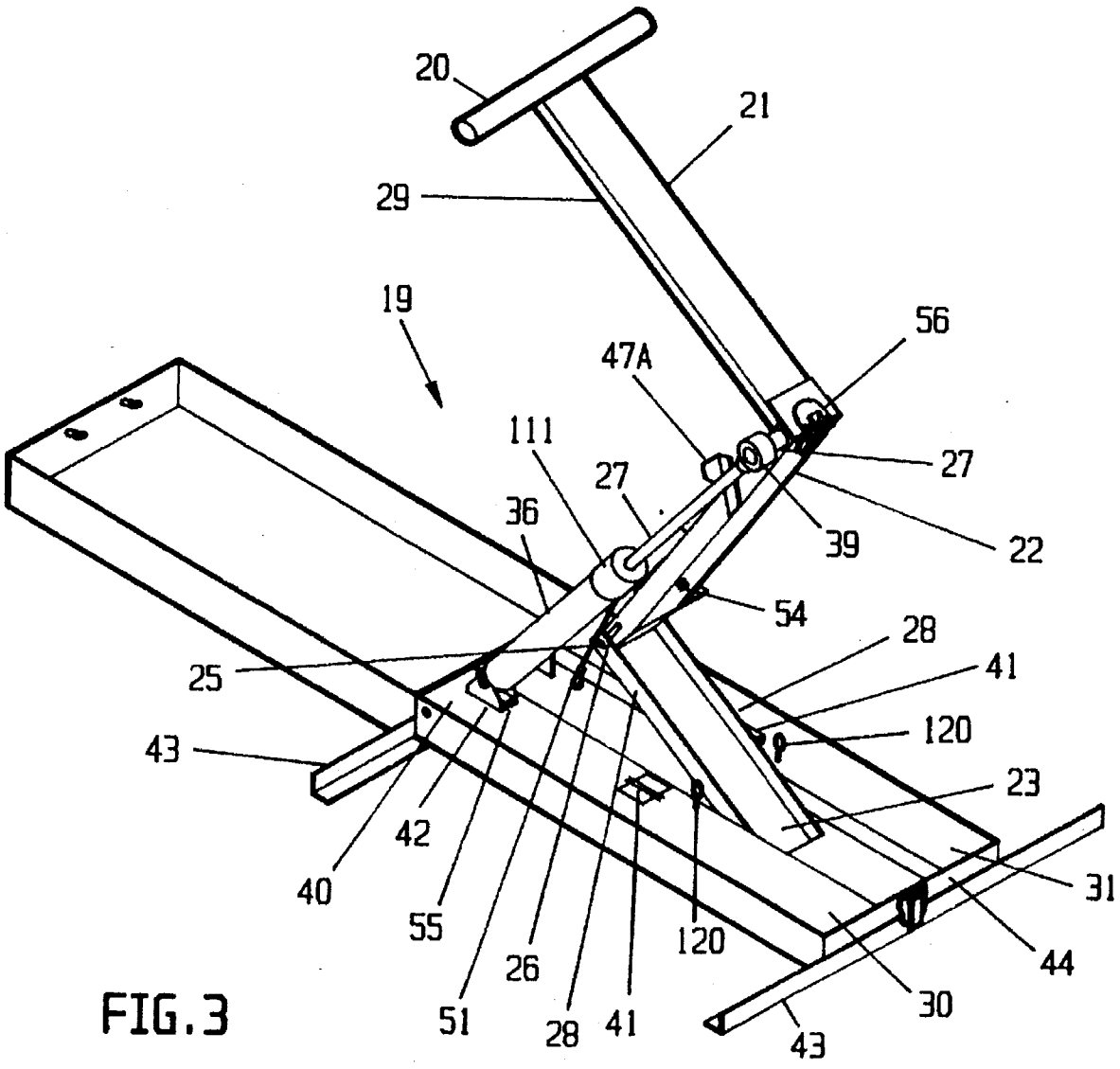
Figure 4:
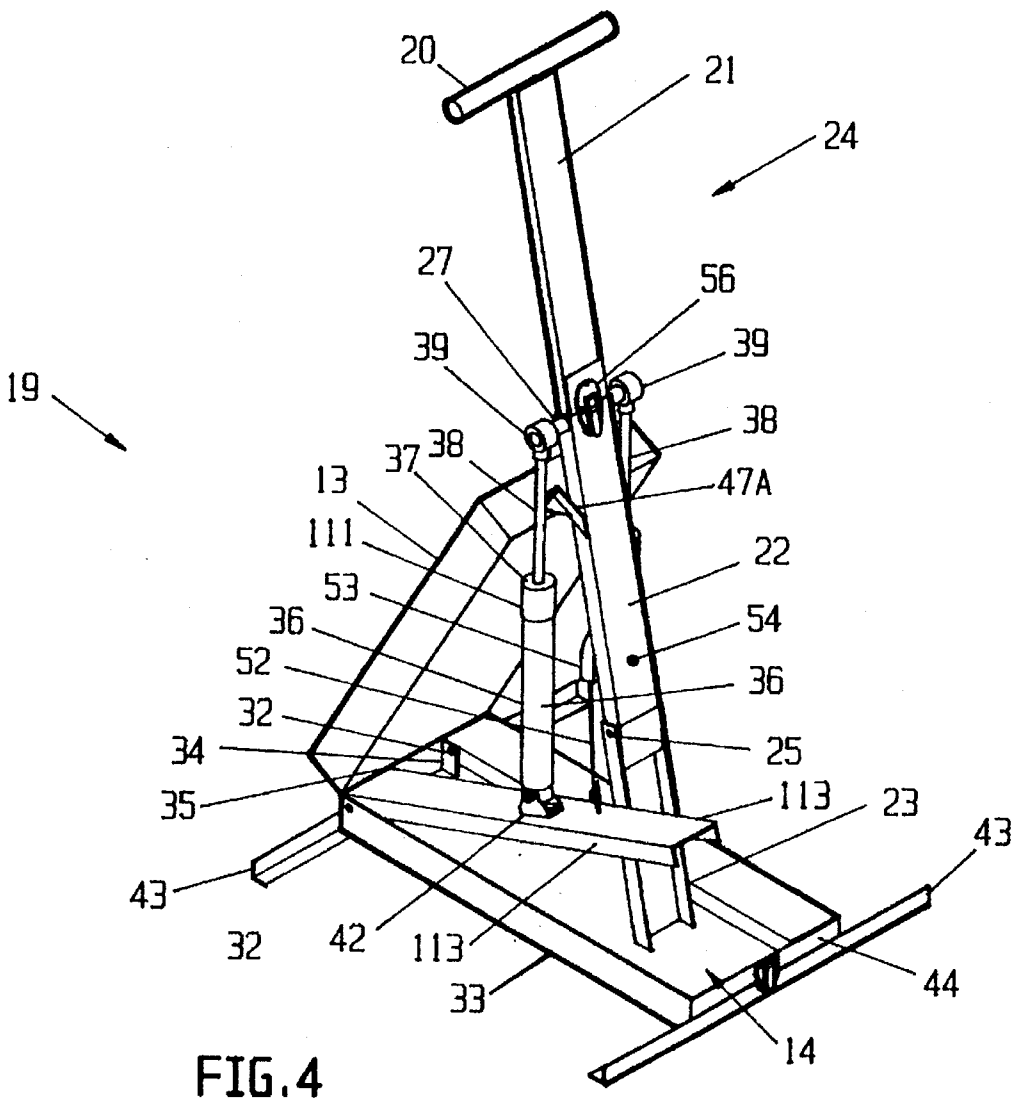
Figure 5:
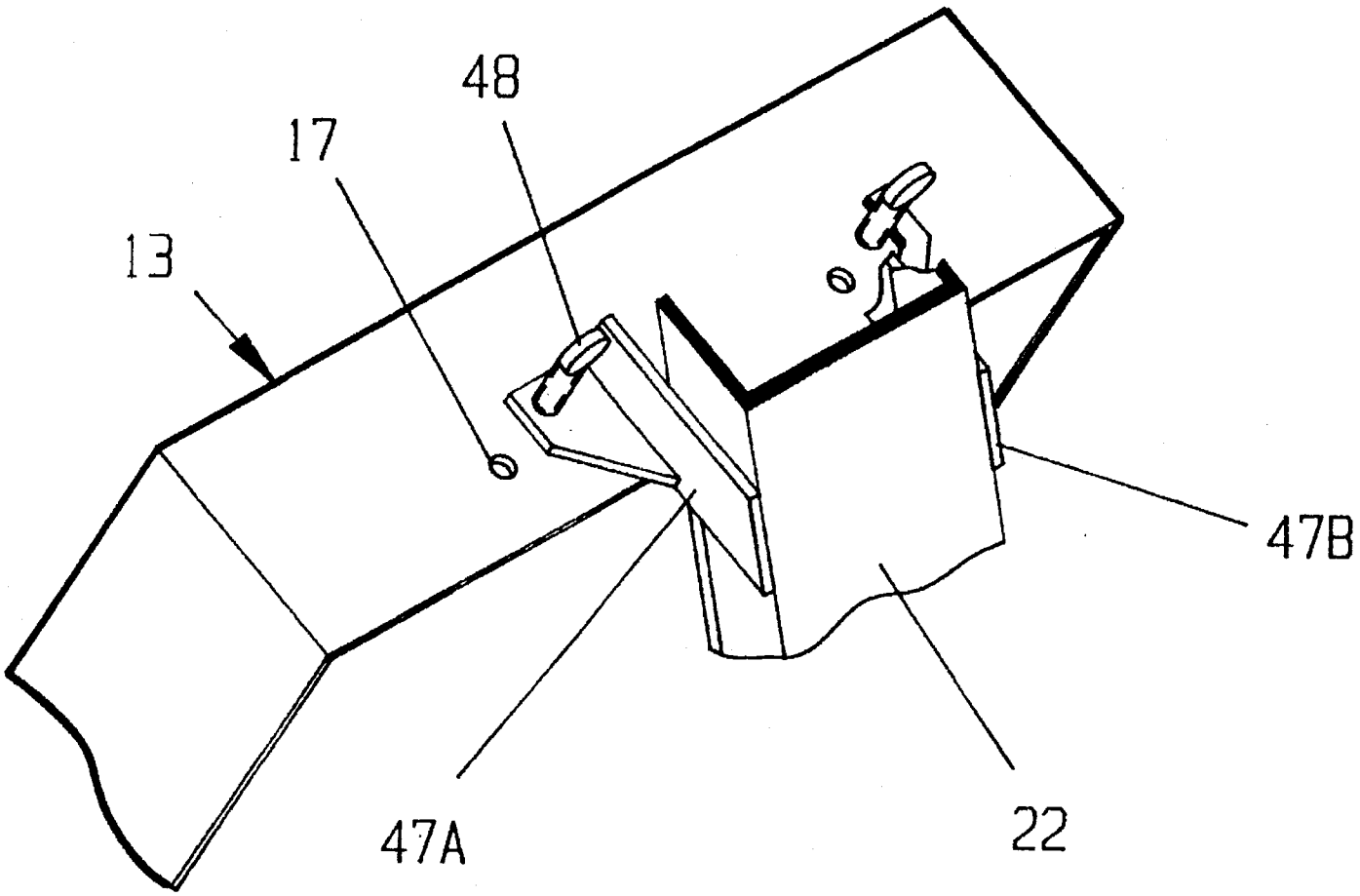
Figure 6:
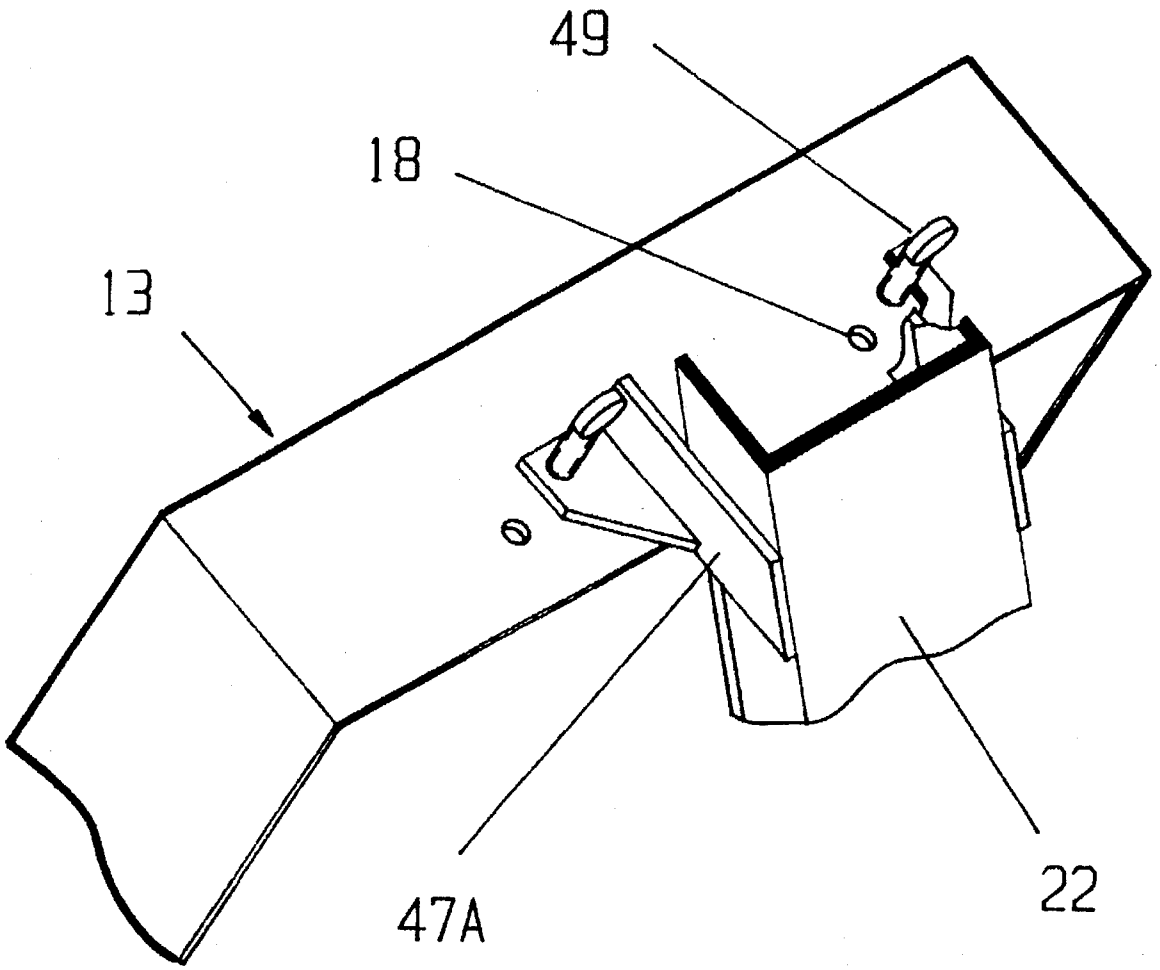

The aerobic exercise equipment 19 shown in FIGS. 2–4 will be understood to be a fixed part of the section 14, but can be extended, although still part of the section 14, by an upwards lifting of the handle 20 and subsequent pulling on it to raise and extend the three sections 21, 22, 23 of its vertical post 24—each section of which is hinged to its adjacent section, as by means of a pin 25 movable within a slot 26 or by means of a rod 27 coupling through the respective sections 21, 22, 23. As will be appreciated, when collapsed away for transportation or storage, the section 22 fits within the opening between the side walls 28 of section 23, and is overlain by the side walls 29 of section 21. While not being shown, it will be understood that the section 23 similarly is able to rotate within the bottom surface of the section 14, so as to lie flat for storage, or to be rotated upwards for use in the "stepmaster" aerobic exerciser.

The two steps of the "stepmaster" are shown at 30 and 31 and are rotatable clockwise and counter-clockwise about a hinge pin 32 formed within the section 14—in one instance as part of the side sectional wall 33, and in a second instance as part of a small plate 34 welded to rear sectional wall 35. A pair of pneumatic cylinders 36 are shown, adjustably rotatable in known manner to adjust the tension afforded thereby, and coupled, at one ends, 37 by a rod 38 to couple with the rod 27 by means of any appropriate coupling, shown at 39. The other end 40 of each pneumatic cylinder 36 is coupled to secure with a fixed stanchion 41 on the steps 30 and 31 by means of a hinge plate 42 which slides over to surround the stanchion 41. A collar 111 on the cylinder 36 adjusts the tension offered by it, depending upon the amount of force desired to depress the steps 30 and 31 as part of the aerobic exercise. Two support arms 43 are shown, to snap onto the rear sectional wall 35 and the front sectional wall 44, to stabilize the "stepmaster" equipment when in use, and to remove them when disassembling the equipment, at which time the arms 43 may be stored under the steps 30 and 31, between their side walls 113, in closing the half section 14 for transporting the aerobic exercising equipment, or for storing it away. A pair of pin projections (not shown) on the arms 43 insert into the holes 177, 178 on the sectional walls 35 and 44 to secure the arms in position.

In securing the vertical post 24 in position, the section 13 is rotated upwardly from the position where it rests on the floor, in order for its apertures 17, 18 to accept projections extending from plates 47A and 47B, respectively, which are both part of the post section 22. More particularly shown in FIGS. 5–6, the plates 47A and 47B are provided with a threaded pin projection 48 which screws into the threaded aperture 17, and with a threaded pin projection 49 which screws into the threaded aperture 18, until both pin projections are tight enough to lock the half section 13 to the post section 22. In such manner, the two half sections 13, 14 provide the support for the "stepmaster" when in use—as well as forming the briefcase unit 10 to carry about the equipment, with the section 13 then fitting onto and overlying the section 14.

A pair of hooks 120 extend from the top of the steps 30, 31, to respectively receive loops 51 at the ends of a wire 52 passing through the grooves of a covered pulley 53. As shown, the pulley 53 is secured to the post section 22, at 54, and stabilizes the wire 52 in its movement.

As will thus be appreciated, the briefcase unit 10 allows for the storage of the "stepmaster" equipment when the equipment is not needed, and permits its carrying about by means of the handle 11, with the two half sections 13, 14 closed by way of the latch 12. As will also be appreciated, the two half sections 13, 14 provide support for the "stepmaster" equipment when the latch. 12 is opened, and the "stepmaster" equipment extended for use. In this manner, a person can take the aerobic equipment along when commuting to an office, when going on a business trip, or when going on vacation. Alternatively, it can simply be set up for use where desired, and when finished with, can simply be closed up and set aside, taking the overall appearance as shown in FIG. 1. When setting up the aerobic equipment, the hinge plate 42, with its channel opening 55 (FIGS. 3, 4), is slid to receive the stanchion 41, the loops 51 are fitted to the hooks 120, a latch 56 is closed to lock the post sections 21 and 22, and the pin projections 48 and 49 of the plates 47A and 47B are screwed into the threaded apertures 17, 18, respectively, to lock the post section 22 to the half sectional—and with the support arms 43 in place, the equipment is ready for use. To break the unit down, these connections are each undone, and the two half sections 13, 14 then closed to give the appearance of FIG. 1.

MUSCLE BUILDING EXERCISE EQUIPMENT

Figure 7:
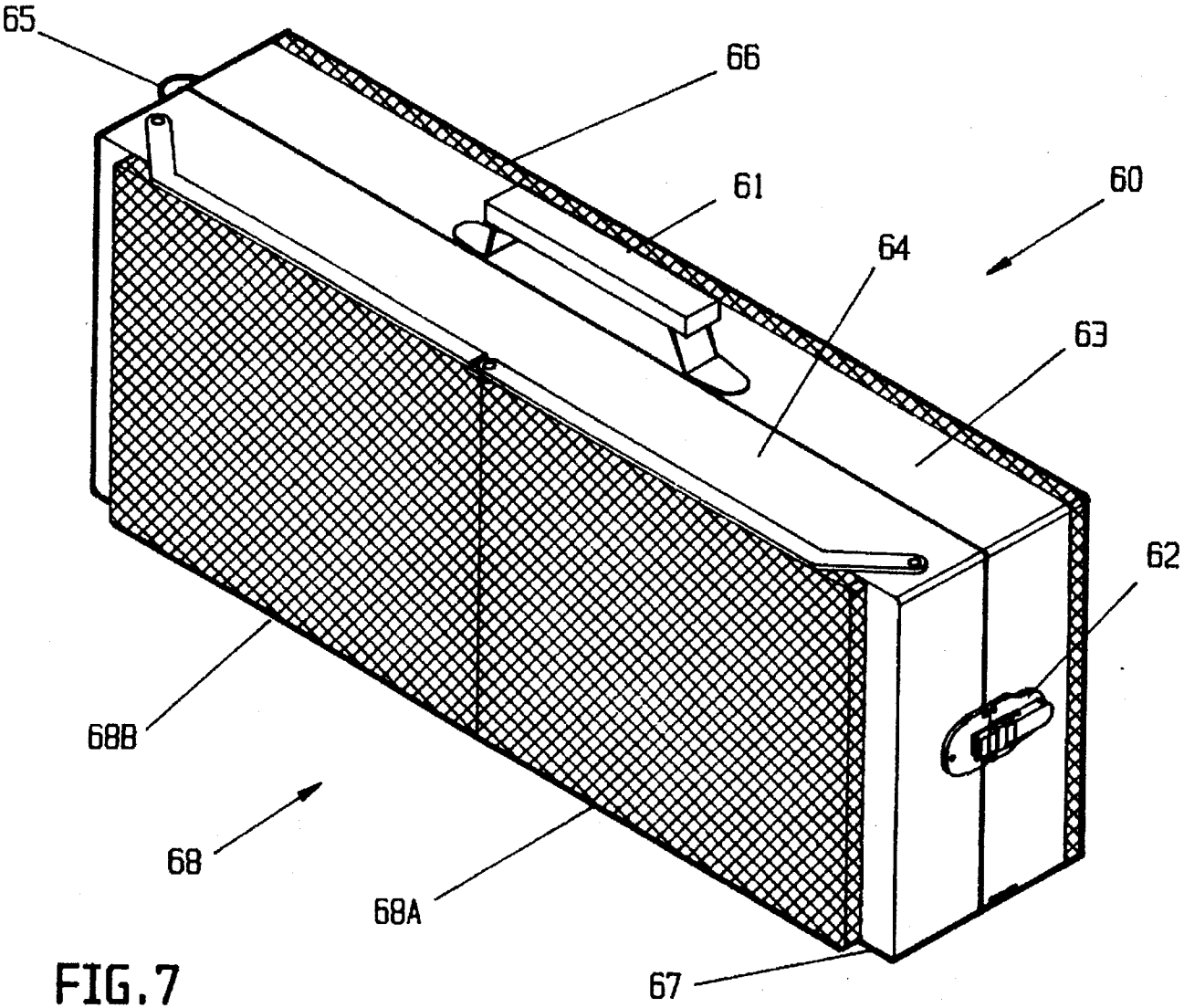
FIGS. 7–15 are pictorial views showing various muscle building equipment, capable of being similarly carried as a briefcase, also in accordance with the invention.
Figure 8:
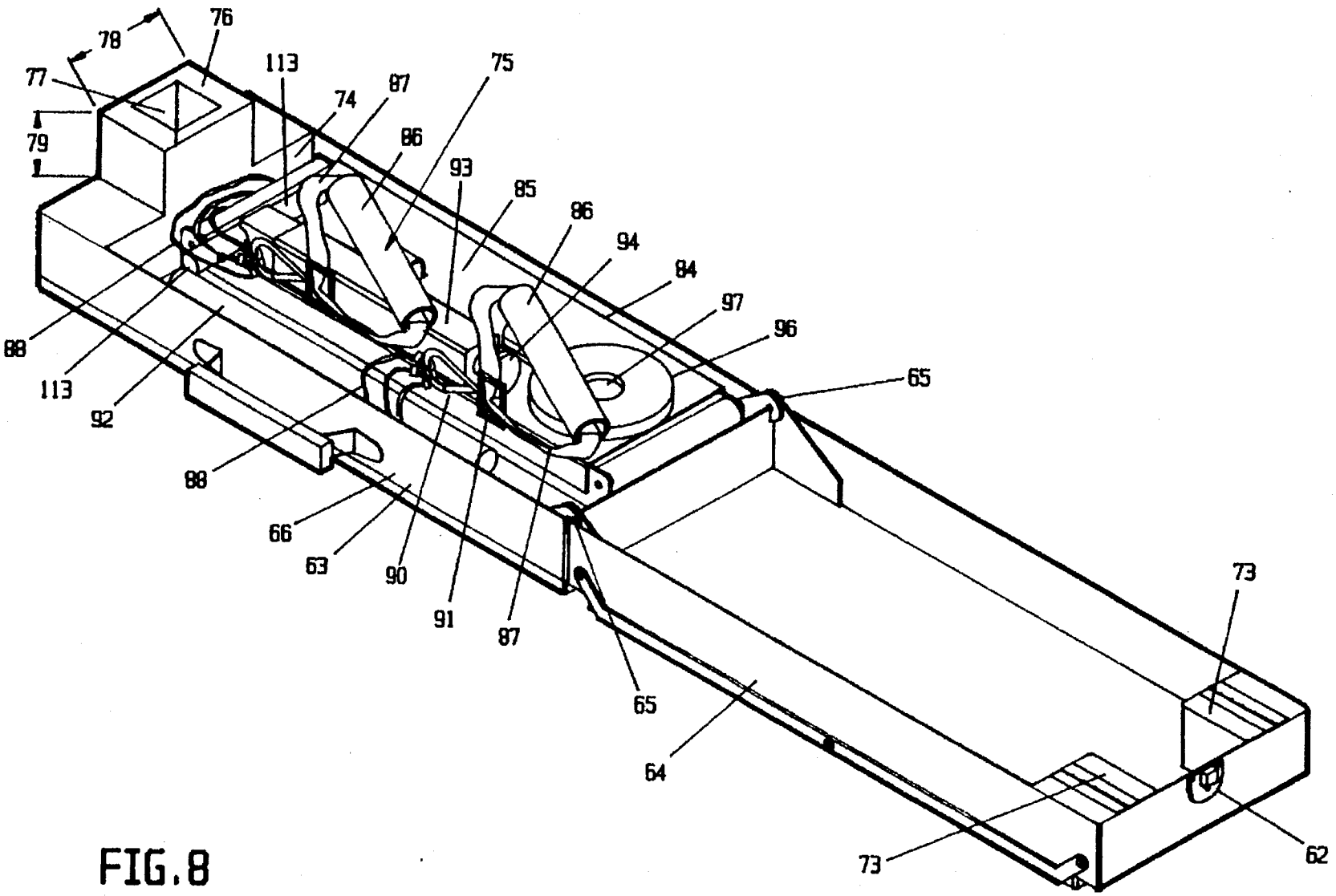
Figure 9:
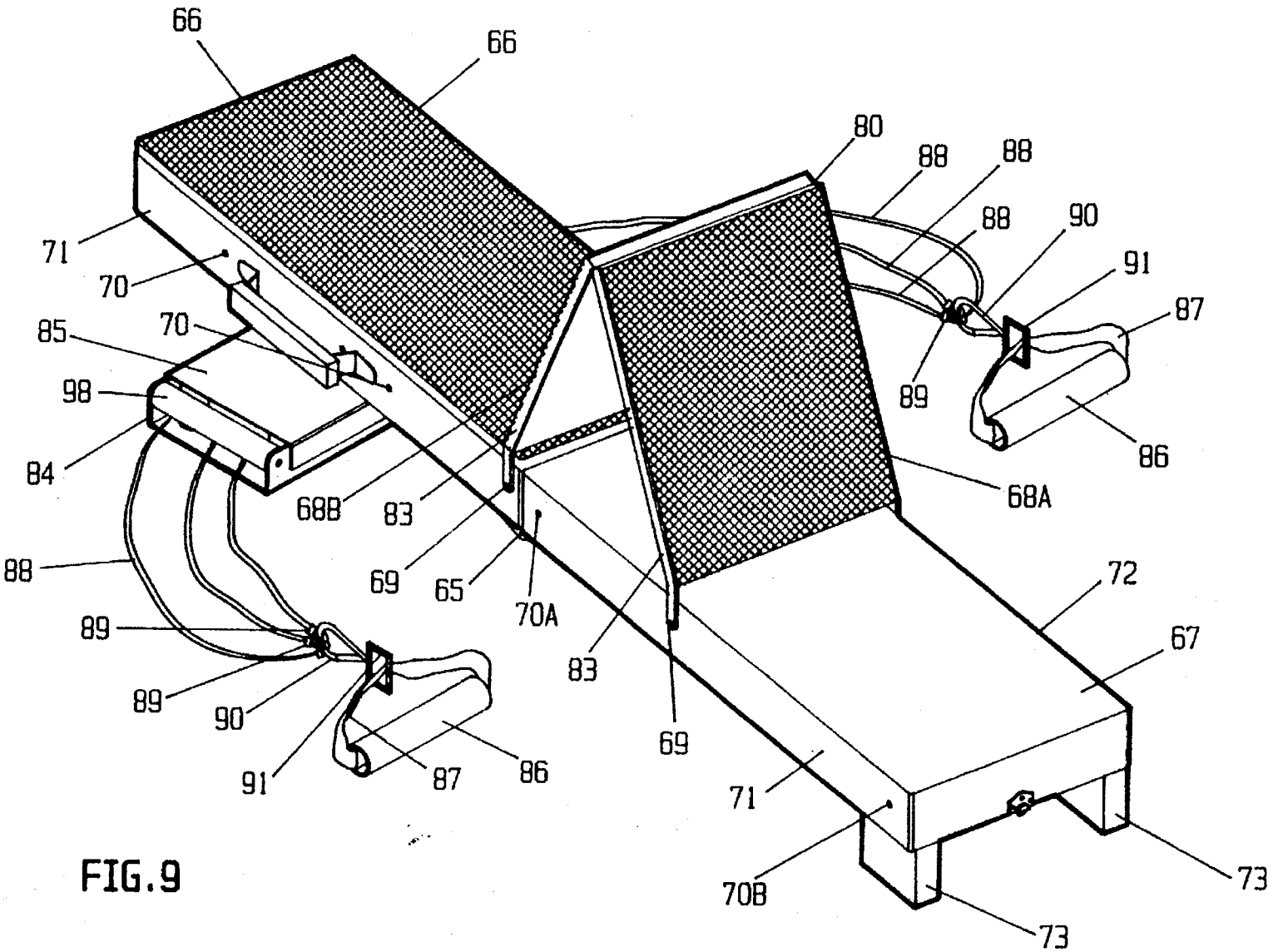

FIG. 7 pictorially shows a similar briefcase unit 60 for the muscle building exercise equipment of the invention. Also shown with a carry handle 61 and a latch 62, the unit 60 will be seen to similarly comprise two half sections when opened, 63, 64, rotated about a hinge 65. As shown in FIGS. 7 through 9, one side 66 of the briefcase unit 60 is shown completely padded (in any appropriate manner), while the other side 67 is overlain with a padded section 68, foldable into two sections 68A and 68B, which is removable from the side 67, by means of pin projections 69 available to fit into any one of a number of apertures 70 along the opposing side walls 71, 72 of the two half sections 63, 64, respectively. As will further be seen from FIG. 8, the half section 64 is generally devoid of anything inside, except for a pair of foldable corner blocks 73, while within the section 63 is a cavity 74 in which is stored the muscle building exercise equipment generally designated by the reference numeral 75 and to be described below. Also within the section 63 is a raised step 76, having an opening therein 77, with the step 76 having a width 78 and a height 79 so as to fit between the corner blocks 73 to allow for the closure of the sections 63, 64 by means of the latch 62, when the briefcase unit 60 is to be carried about, or simply stored away.

Figure 10:
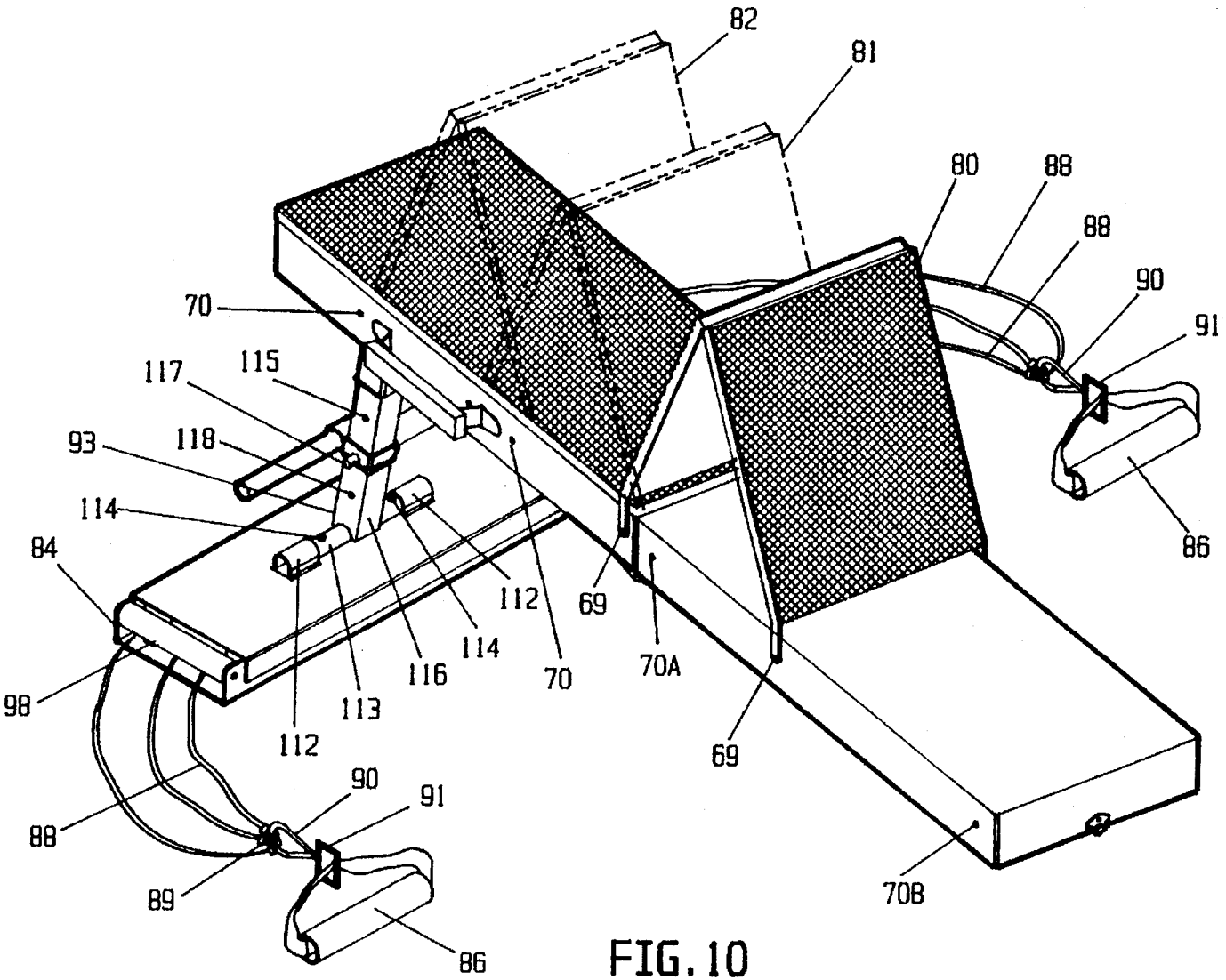

FIGS. 9 and 10 in part show the briefcase unit 60 being set up as a slant-board when laid on a floor with the padded section 66 facing upward. In such instance, both sides 66 and 67 of the unit 60 are rotated open, adjacent one another, with the padded sections 68A and 68B then being adjusted and placed so that their pin projections 69 fit within any of the selected apertures 70 on the side walls 71, 72 at the desired location. One such position is shown by the reference numeral 80 in FIGS. 9 and 10 with alternative positions for the sections 68A, 68B being shown in phantom at 81, 82, in FIG. 10 as an illustration. While the height 79 of the raised step 76 provides a tilt toward the corner blocks 73 of the slant board, it may, in some instances, be desired to provide an opposite tilt to the slant board, instead—as may be accomplished by unfolding the corner blocks 73 (FIG. 9) and/or by placing several books beneath the corner blocks 73. this usage, the person exercising would typically sit on the padded section 66, with his, or her, back bearing up against the padded section 68B, in doing various exercises with others of the muscle building exercise equipment to be described as incorporated within the present invention. When it is desired to store the unit away, the padded sections 68A, 68B are simply removed from the apertures 70 in which they have been set up, and repositioned by means of the pin projection 69 back into the apertures shown as 70A and 70B in FIGS. 9 and 10 for carrying about, or merely for storage. In this respect, it will be appreciated that the side walls 83 of the slant board sections 68A, 68B are flexible to permit their outward spreading to remove the pin projections 69, and to allow them to spring back into position when inserted into the desired apertures in the two side walls 71. As will be seen from the following description, the padded sections 66, 68 also allow for the muscle building exercising of the invention, beyond merely serving as a portion of the briefcase carrying unit 60.

Thus, referring to FIG. 8, it will be seen that stored in the cavity 74 of the carrying case unit 60 is a box 84 having a removable cover 85, a pair of hollow handles 86, straps 87 passing through each handle, Bungee cords 88, a series of loops 89 at the ends of the Bungee cords and a hook 90 connecting the loops 89 to a frame 91, through which the straps 87 pass. Also shown in FIG. 8 is one of a pair of cylindrical rods 92 of a diameter less than the inside diameter of the hollow handles 86, a post 93 of a rectangular cross section for fitting the post 93, and a disk 94 at one end thereof, into the opening 77 of the raised step 76 (FIG. 8). Additionally shown in FIG. 8 is a larger disk 96 having a circular opening 97 in its underside, of a dimension to accept the smaller disk 94 when in use. As will be appreciated, FIG. 8 shows these component parts of the muscle building exercise equipment 75 as they would appear when packed for storage, or for travel in the briefcase carrying unit 60 prior to its being closed by latching the section 64 over the section 63. When that occurs, and as previously noted, the briefcase carrying unit 60 then takes on the appearance as shown in FIG. 7. FIG. 9 shows the half sections 63, 64 arranged to provide the slant board feature of the portable gym equipment, and also shows some of the afore-described muscle building exercise equipment removed from the cavity 74. As illustrated, the Bungee cords 88 extend out from the box under a roller 98. This type of muscle building equipment will be more clearly understood by referring to FIGS 10–15.

Figure 11:
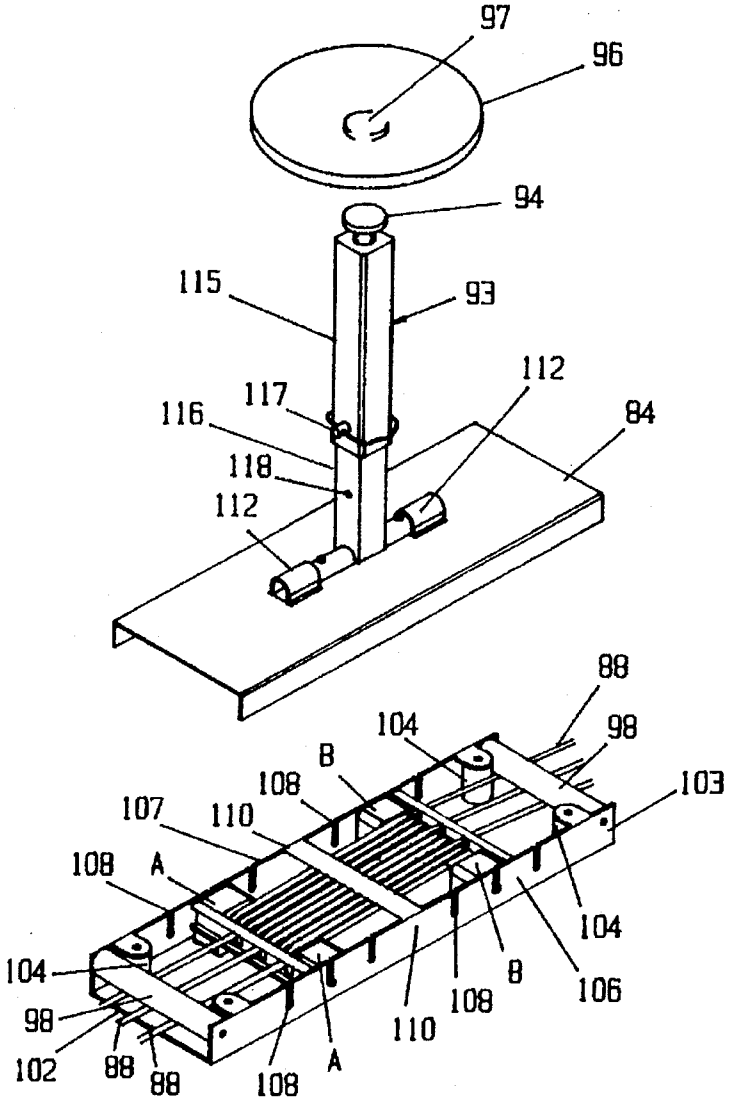
Figure 12B:
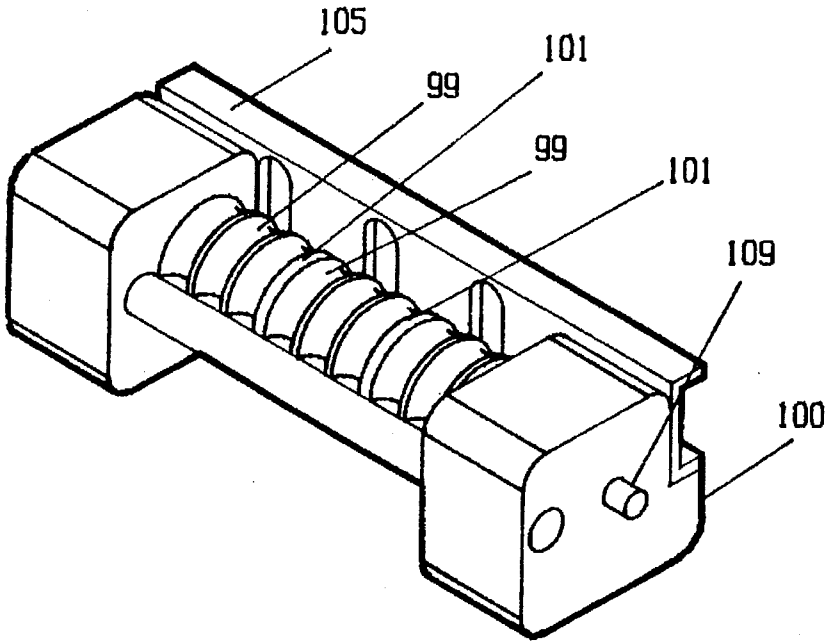
Figure 12A:
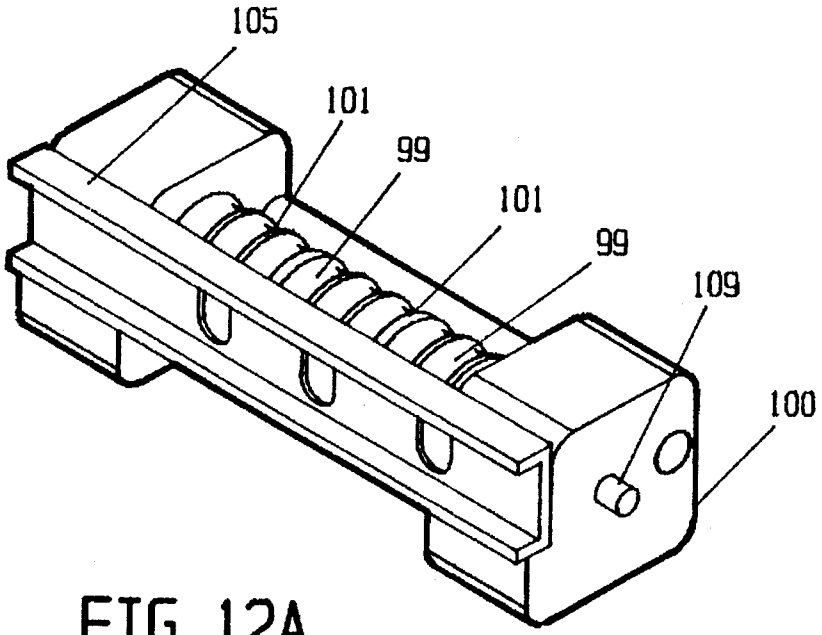
Figures 13A, 13B:
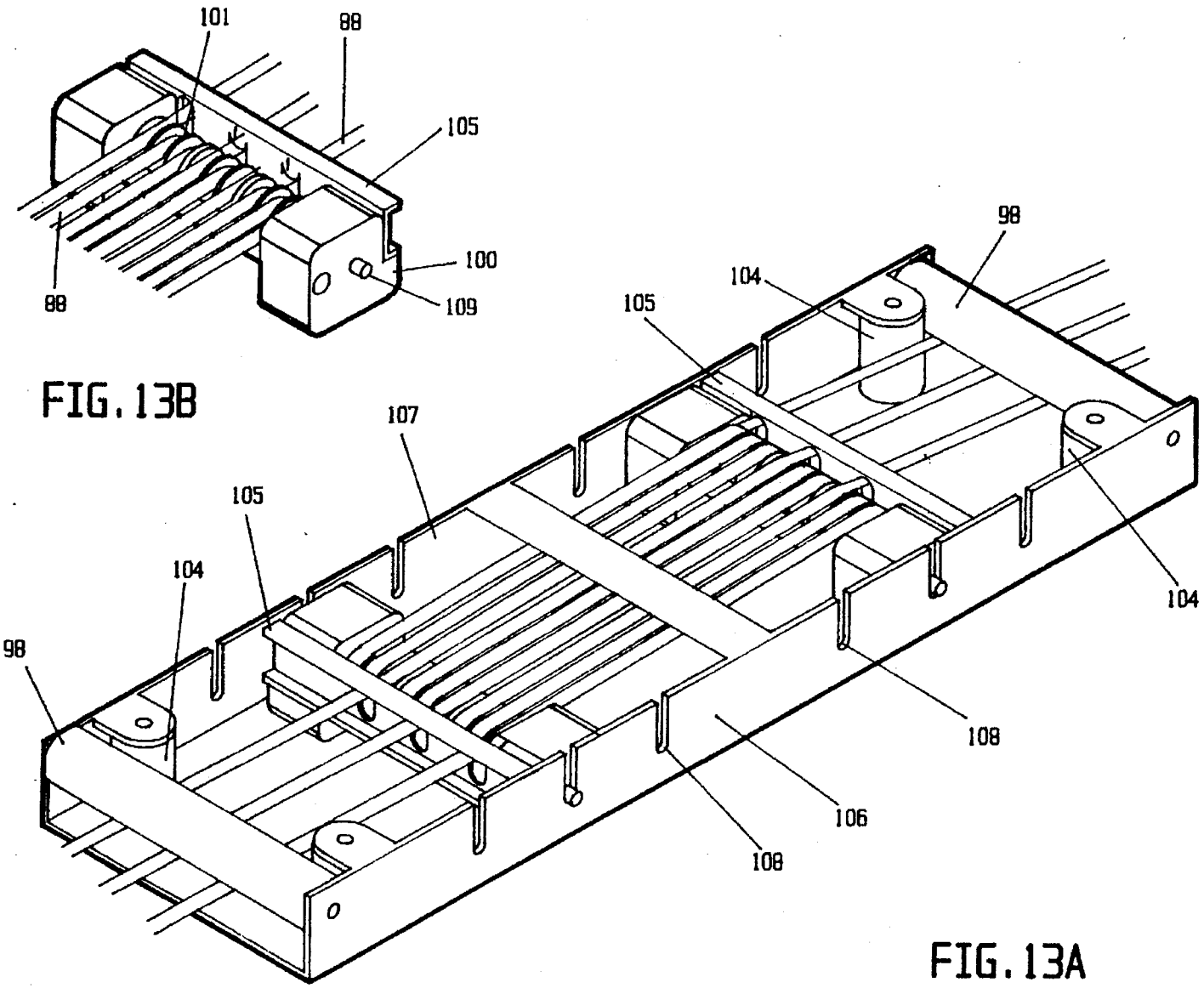
Figure 14:
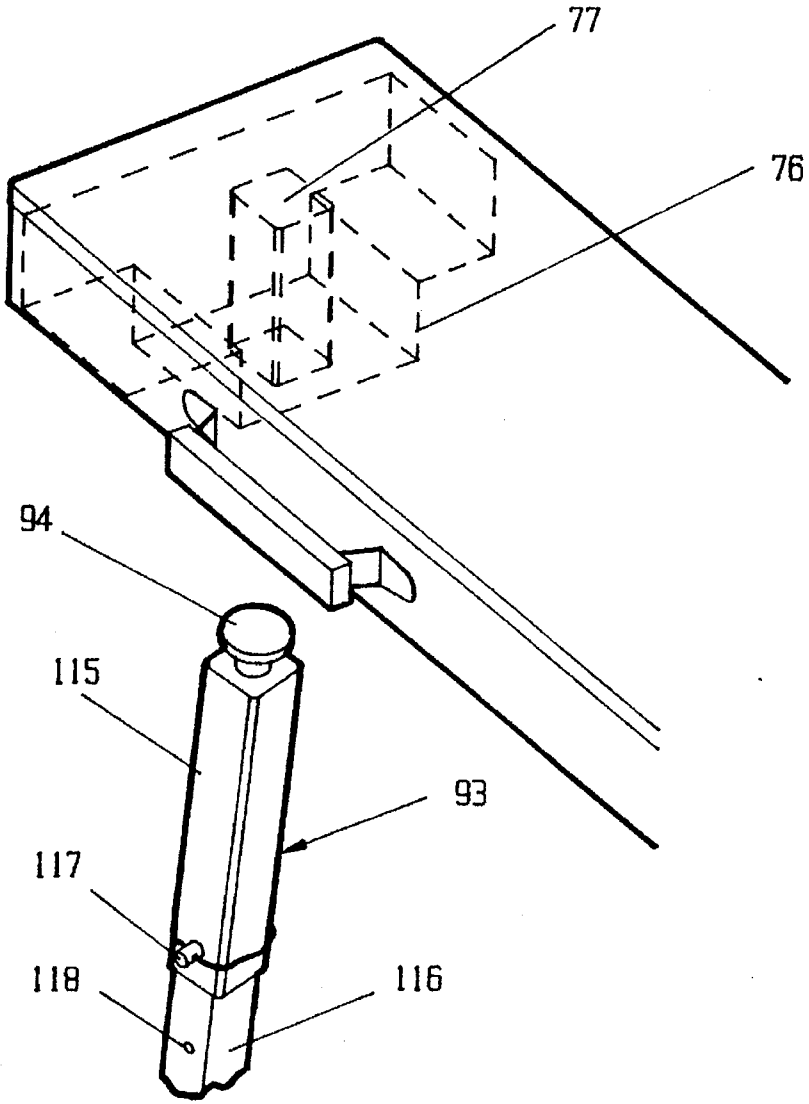

As FIG. 10 illustrates, each Bungee cord 88 extends under its respective roller 98 and comprises a single length of expandable, yet resistant material. FIGS. 11–13 show the Bungee cord 88 wrapped within grooves 99 formed on a movable pulley 100, as between adjacent teeth 101. Two such pulleys are shown, one (A) facing the left side end 102 of the box 84 and one (B) facing the right side end 103. Four additional rollers 104 are included in guiding the Bungee cords 88 below the rollers 98, upon a user's pulling on the hollow handle 86 to which the Bungee cords are connected. A series of lateral guides 105 maintain the Bungee cord flat within the box 84 and prevent its twisting, shown as riding over the Bungee cords 88 as they are being pulled. As shown in FIGS. 11 and 13, the front and rear walls 106, 107 of the box 84 are slotted, as at 108, to allow for changing the positioning of the movable pulley 100 in one instance closer to (or further from) the left side end 102 of the box 84, and in a second instance closer to, or further from, the right side end 103 of the box 84. Moving the pulleys such that their extensions 109 seat within different slots 108 alters the tension afforded by the Bungee cords 88, in a way that moving the pulleys 100 closer to the middle (illustrated at 110) gives to the Bungee cords their longest length and their least tension. Conversely, moving the pulleys 100 toward the side ends 102, 103 shortens the length of the Bungee cord available for a user to pull on, to increase the tension available. As will be readily appreciated by those skilled in the art, lifting the cover 85 off the box 84 makes all its component parts available for adjustment—even to the extent of removing one or more of the three Bungee cords 88 shown for purposes of illustration, or for changing their composition in varying the force needed for them to be stretched. In this respect, individual ones of the loops 89 shown in FIGS. 9 and 10 can be removed from the hooks 90 in controlling the amount of strength needed to stretch that cord or those cords traversing the grooves 99 of the movable pulleys 100.

FIGS. 9, 10, 11, 14 and 15 illustrate different ways of performing muscle building exercises according to the invention. In FIG. 9, for example, the box 84 can rest below the inverted section 63 of the slant board configuration, and a user can sit on the padded section 66 with his, or her, back against the section 68B, while grasping onto the handles 86 in performing various pulley movements against the tension afforded by the Bungee cords 88. Once that is completed, the user might desire to simply slide the box 84 out from under the slant board, stand on its cover 85, or lean on it with the knees, and again do various exercises pulling on the hollow handles 86.

FIG. 10 illustrates a situation where the slant board is set at a greater angle with respect to the floor, and is effected by yet a further variant of this muscle building exercise equipment. Thus, the cover 85 on the box 84 includes a pair of circular clamps 112 through which is passed a further rod 113 connected to the vertical post 93, including a pair of compressible pins 114 extending from the rod 113 to be rotated within the circular clamps 112—and, until the pins 114 fit within recesses inside the clamps 112 (not shown) in varying the angle that the post 93 makes with the box 84, and to then be held in position. At the same time, the post 93 will be appreciated as being of two sections 115 and 116 to overlap one another in telescoping manner, until a desired length is reached, at which a pin projection 117 on the section 115 mates with an aperture 118 on the section 116, to then lock the two in position. With the disk 94 of the post 93 then fitting within the opening 77 of the raised step 76 (FIG. 14), the slant board can be adjusted in angle and height, for exercising with the Bungee cords 88 at the slant board position dictated by the selected placement of the padded sections 68A and 68B, as in FIG. 10.

Figure 15:
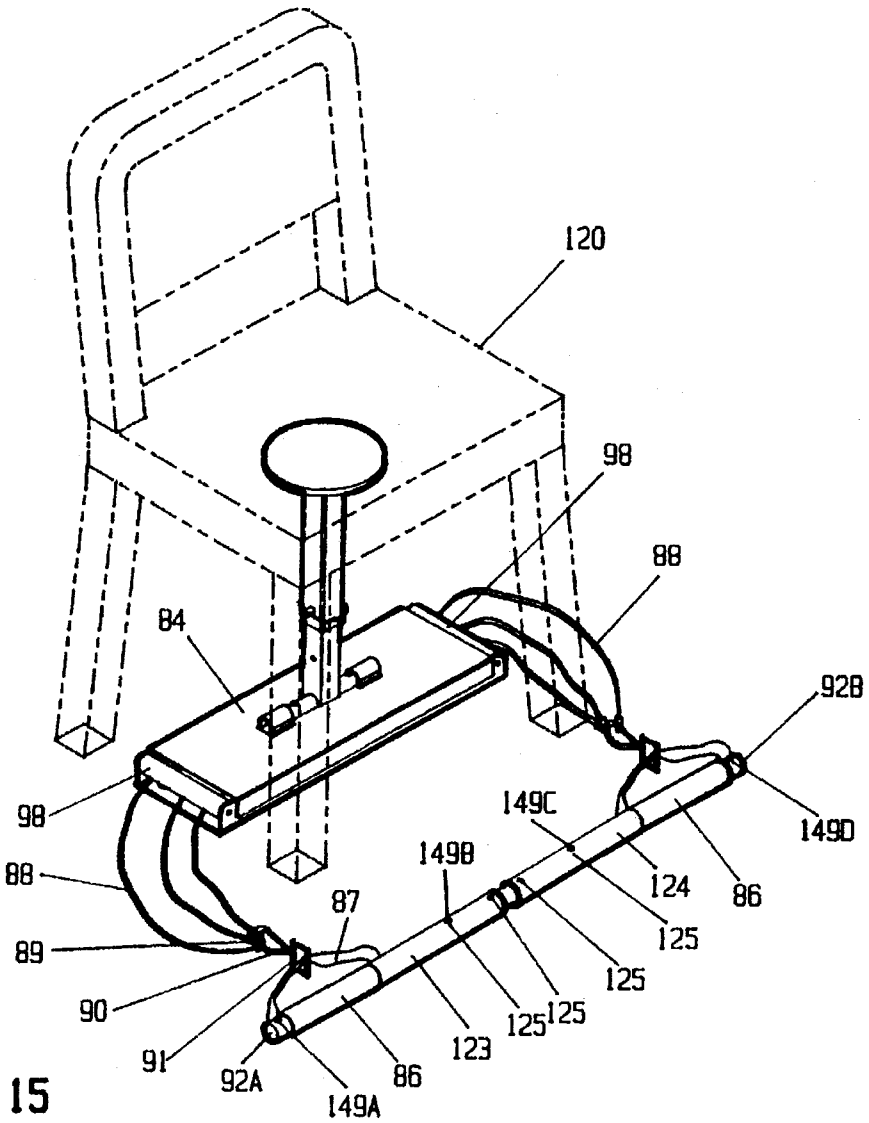

FIG. 11, in similar manner, shows the disk 94 arranged to fit the opening 97 in the larger disk 96. Again, two sections and 116 are shown for the telescoping post, to enable the post 33 to be raised to reach the underside of a seat 120 of a chair 121 (FIG. 15). There, a user of the equipment can sit and perform the various exercises with the Bungee cords, before packing away for storage or transport. In such instance, if the apertures 118 on the post section 116 are not such as to telescope the disk 96 to contact the seat 120, the box 84 can simply be rested atop newspapers, magazines, or books to raise the disk 96 to bear against the seat underside.

FIG. 15 illustrates a further feature of the invention in its incorporation of the two rods 92A and 92B inserted through facing ends of the hollow handles 86 so as to present a "bar" to be raised and lifted in exercising use. In such an arrangement, the handles 86 receive pin projections 149A and 149D, which are located at the ends of the two rods, 92A and 92B; these pins are depressed to allow each rod to pass through its respective handle and once through, each pin "pops up" to lock the handles in place against cylindrical sheaths 123, 124 which surround the rods 92A, 92B. As more particularly shown, both rods are used with the handles 86, and along these rods are placed pin projections, 149A, 149B, 149C, 149D; pin projections 149B and 149C slide inside the sheath to then "pop up" into sheath apertures 125, thereby locking each sheath in a fixed position and allowing the bar to adjusting to varying lengths, while pin projections 149A and 149D "pop up" outside each handle to secure the handles against their respective sheaths. As will be apparent, a single rod could be utilized instead to form a bar of fixed length.

Then, with the vertical post 93 locked in position, various additional exercises can be carried out with the muscle building Bungee cord arrangements, for the front shoulder muscles, over the head for the rear shoulder muscles, for the back, for the triceps, for the chest muscles, etc. Alternatively, one can stand on the box 84 itself—being made of metal to support one's weight, for example—and just pull up on the handles 86 or rods 92A and 92B, in doing curls and other exercises for stomach or back muscles, or as desired. In this this way, any one of a number of different muscle building exercises can be accomplished, either standing, on the slant board, or sitting on a chair. As will be appreciated, the box 84 with its handles 86, its Bungee cords 88 and its rods 92 forming an adjustable "bar", together comprise an ultra-light, easily transportable, independent muscle-tone exerciser.

At the conclusion of the exercising, one need only lower the slant board sections 68A, 68B to lie flat, reverse the positioning of the carry case sections 63, 64 to the position shown in FIG. 7, and load back the various muscle building exercise equipment 75 as there shown. Closing the case then presents, once again, the appearance of FIG. 7.

Figure 16:
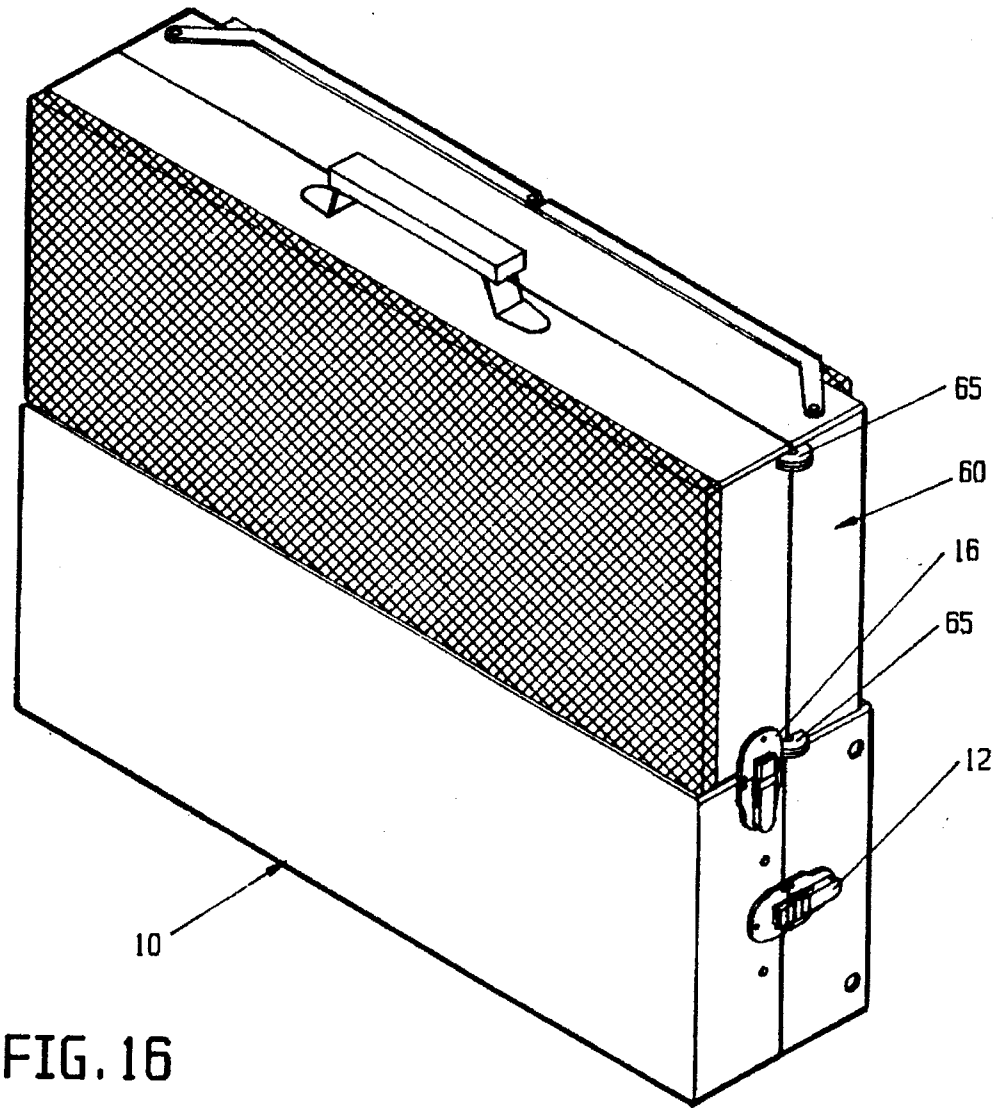
FIG. 16 illustrates the two "briefcase-sized units" coupled together to be carried as a single suitcase, according to another aspect of the invention.

FIG. 16 shows the present invention taken one step further, by joining the briefcase unit 10 for the aerobic exercising equipment with the briefcase unit 60 for the muscle tone exercising equipment. To such end, the handle 11 (FIG. 1) is rotated clockwise or counterclockwise to lie flat, and a further latch segment 131 is affixed on the end of the briefcase unit 60 remote from that shown in FIG. 7, to clasp the two briefcase units together. Thus, and in accordance with the teachings of the invention, the two units can be carried about just as a suitcase can, in transporting the equipment from one place to another—be it to the office, or to a hotel—or simply from room-to-room. As such, users will always have available the type of equipment which has become familiar to them, and which can be carried with them when away from home. In one construction of these inventions, an overall package for both briefcase units weighed only about 30 pounds. As will be appreciated, once the two briefcase units 10 and 60 are unlatched, the handle 11 can be rotated to its erect position of FIG. 1 and the unit 10 can be carried about independently. At the same time, the handle 61 can be lifted upward from its collapsed position to its erect position of FIG. 7 to likewise be carried separately. Rotating the handle 11 flat, or exerting a downward force on the handle 61, then simplifies the storage of the units 10 and 60.

While there have been described what are considered to be preferred embodiments of the present invention, it will be readily appreciated by those skilled in the art that modifications can be made without departing from scope of the teachings herein. For at least such reason, therefore, resort should be had to the claims appended hereto for a true understanding of the scope of the invention covered by this description.

I claim:

1. Aerobic exercise equipment for a portable personal gym, comprising:

a carrying case having first and second facing sections, each section having a first end and a second end;

hinge means coupled between said first and second facing sections at first ends of said first and sconds sections for rotating said sections away from each other in opening said carrying case and for rotating said sections toward one another in closing said case;

a normally collapsed exercise unit within said first section including a post to extend upwardly from inside said first section, a pair of pneumatic cylinders coupled to said post, and a pair of pressure actuated steps coupled to said pneumatic cylinders;

a handle coupled to said post to aid in extending said post, said cylinders and said steps in opening said exercise unit within said first section;

whereby with said exercise unit extended to an open position, said pressure actuated steps alternately lower and raise with respect to said first section by the action of a user of said equipment exerting a downward force on said steps; and securement means on at least one of said post or said second section for fastening said post to said second, section when said second section is rotated vertically upwardly about said hinges means towards said first section and attaching said post to the second end of said second section.

2. The aerobic exercise equipment of claim 1, wherein said securement means is adjustable for releasing said post from said second section to permit rotation of said second section about said hinge means away from said first section.

3. The aerobic exercise equipment of claim 2, also including means extending laterally of said first section to stabilize said aerobic exercise equipment at a ground surface when in use.

4. The aerobic exercise equipment of claim 2, wherein said post is composed of a plurality of overlying sections interfitting within one another, together with hinge means for rotating said overlying sections opened or closed as desired.

5. The aerobic exercise equipment of claim 4, including latch means for locking said plurality of overlying sections together when rotated to an open position.

6. The aerobic exercise equipment of claim 2, wherein said pneumatic cylinders are adjustable in tension for regulating the amount of downward force needed to lower and raise said steps.

7. The aerobic exercise equipment of claim 2, also including latch means on said first and second facing sections for fastening said first and second sections when rotated to a closed position.

8. The aerobic exercise equipment of claim 7, also including a carry handle connected to said second section.

9. The aerobic exercise equipment of claim 2, also including wire means extending between said post and said steps for limiting the amount of lowering and raising of said steps.

10. The aerobic exercise equipment of claim 2, also including means for slidably coupling said pneumatic cylinders to said steps in locking said cylinders in position.

11. The aerobic exercise equipment of claim 2, wherein said securement means includes a pair of hinged plates on said post, a pin projection extending from each hinged plate, and a pair of apertures within said second facing section to receive said pin projections.

12. The aerobic exercise equipment of claim 11, wherein said pin projections and said apertures are threaded to provide a high degree of securement therebetween.

13. The aerobic exercise equipment of claim 2, also including latch means on said second facing section for coupling said carrying case to a second carrying case in tandem.

14. The aerobic exercise equipment of claim 8, wherein said carry handle, once extended, is collapsible against said second facing section by rotation clockwise or counterclockwise.

* * * * *